US006021301A

United States Patent [19]

Shigeta et al.

[11] Patent Number: 6,021,301

[45] Date of Patent: Feb. 1, 2000

[54] IMAGE FORMING APPARATUS WHICH IS EQUIPPED WITH AN INTERMEDIATE TRANSFER BODY AND WHICH PREVENTS TONER FROM STICKING TO A TRANSFER UNIT

[75] Inventors: Kunio Shigeta; Yotaro Sato; Hisayoshi Nagase; Satoshi Haneda, all of Hachioji; Toshihide Miura, Koganei, all of Japan

[73] Assignee: Konica Corporation, Tokyo, Japan

[21] Appl. No.: 09/154,764

[22] Filed: Sep. 17, 1998

[30] Foreign Application Priority Data

Sep. 26, 1997 [JP] Japan ..... 9-261911

[51] Int. Cl.[7] ..... G03G 15/16; G03G 15/14; G03G 15/00

[52] U.S. Cl. ..... 399/311; 399/399; 399/400

[58] Field of Search ..... 399/302, 309, 399/312, 308, 311, 397, 398, 399

[56] References Cited

FOREIGN PATENT DOCUMENTS 49-37538 10/1974 Japan .
54-28740 9/1979 Japan .
4-214576 8/1992 Japan .
9-258492 10/1997 Japan .

*Primary Examiner*—William Royer
*Assistant Examiner*—Hoang Ngo
*Attorney, Agent, or Firm*—Frishauf, Holtz, Goodman, Langer & Chick, P.C.

[57] ABSTRACT

An image forming apparatus includes: an image forming body; an intermediate transfer body for carrying a toner image transferred from the image forming body and conveying a transfer material thereon; a first transfer device for transferring the toner image on the image forming body onto the intermediate transfer body or a front side of the transfer material; a second transfer device for transferring the toner image on the intermediate transfer body onto a back side of the transfer material; and a fixing device for fixing the toner image transferred on the transfer material. The second transfer device includes a corona discharger having a discharging electrode and a shielding member for shielding an electric field when the discharging electrode discharges, and the shielding member has a circulation hole through which air flows along an outer circumferential surface of the intermediate transfer body in a conveyance direction from upstream to downstream of the transfer material.

9 Claims, 6 Drawing Sheets

IMAGE FORMING APPARATUS WHICH IS EQUIPPED WITH AN INTERMEDIATE TRANSFER BODY AND WHICH PREVENTS TONER FROM STICKING TO A TRANSFER UNIT

BACKGROUND OF THE INVENTION

The present invention relates to an image forming apparatus, and more particularly, to an image forming apparatus suitable for forming images on both sides of a transfer material through an electrophotographic method. An image forming apparatus of the present invention can be used for a copying machine, a printer and a facsimile machine.

In the conventional double-sided image forming apparatus, there has been used a method wherein an image for one side of a document formed on an image forming body is transferred onto a transfer material to be fixed which is then stored temporarily in an intermediate tray, and the transfer material is then fed out of the intermediate tray in synchronization with an image for the other side of the document formed on the image forming body to be transferred and fixed on the other side of the transfer material.

In the conventional image forming apparatus described above, the transfer material which has been subjected to fixing is fed to an intermediate tray, and the transfer material passes through a fixing unit twice. Therefore, the image forming speed is slow and conveyance of the transfer material is less reliable and often results in jams.

For overcoming this weak point, JAPANESE TOKKOSHO Nos. 49-37538 and 54-28740, and JAPANESE TOKKAIHEI No. 4-214576 have disclosed a double-sided image forming apparatus wherein after the first image is formed on an image forming body, the image is transferred temporarily onto an intermediate transfer body and the second image is formed on the image forming body. Then the first image on the intermediate transfer body is transferred onto one side of the transfer material, and the second image on the image forming body is transferred onto the other side of the transfer material. These images are then fixed simultaneously so that images are formed on both sides of the transfer material. The inventors of the present invention have studied how to put the aforesaid double-sided image forming system to practical use, and have filed applications for several further inventions, beginning with JAPANESE TOKKAIHEI No. 9-258492.

During the inventors' study, it was learned that, toner soil was deposited in the vicinity of an intermediate transfer body in an image forming apparatus equipped with an intermediate transfer body, and it was found that there is a problem which needs to be solved. The toner soil will be explained with reference to FIG. 1. Transfer unit CO which is composed of a corona charging unit and transfers toner images from an intermediate transfer body to a transfer material is arranged to be close to intermediate transfer body M through a narrow clearance as shown in the drawing, and a current of air caused by the circulating movement of the intermediate transfer body during transfer of the toner images is generated in the narrow clearance. It was observed that this current of air caused a vortex of air current $R_1$ and a vortex of air current $R_2$ in the vicinity of the transfer unit CO, as shown in the FIG. 1. As a result, toner sticking and toner adherence to shielding member H of the transfer unit CO were caused as shown by $W_1$ and $W_2$, thereby deteriorating efficiency of the transfer unit.

In the aforesaid double-sided image forming apparatus equipped with an intermediate transfer body, guiding members such as separation claws and spurred wheels are used to separate the transfer material carrying on its both sides unfixed toner images from the intermediate transfer body and to guide it to a fixing unit, and it was found that toner sticking was caused also on a guiding portion having the guiding members.

The above described problem is caused because unfixed toner is held on both sides of a transfer material at the position where toner images are transferred from an intermediate transfer body to a transfer material, and toner tending to scatter is concentrated in this portion.

SUMMARY OF THE INVENTION

Therefore, an object of the invention is to provide a stable and efficient image forming apparatus equipped with an intermediate transfer body, wherein it is possible to prevent toner sticking to a component such as a transfer unit arranged in the vicinity of a position for toner images to be transferred to a transfer material from an intermediate transfer body where toner tending to scatter is concentrated.

The object of the invention can be attained by either one of the following structures.

(1) An image forming apparatus having therein an image forming body, an intermediate transfer body which carries toner images transferred from the image forming body and supports and conveys a transfer material, a first transfer means which transfers toner images on the image forming body onto the intermediate transfer body or onto the obverse side of the transfer material, a second transfer means which transfers toner images on the intermediate transfer body onto the reverse side of the transfer material, and a fixing means which fixes toner images transferred onto the transfer material, wherein the second transfer means is composed of a corona discharger having therein a discharging electrode and a shielding member which shields an electric field in the course of discharging, and the shielding member is provided with a circulation hole through which air flows along an outer circumferential surface of the intermediate transfer body from the upstream side to the downstream side in the direction for conveying the transfer material.

(2) An image forming apparatus having therein an image forming body, an intermediate transfer body which carries toner images transferred from the image forming body and supports and conveys a transfer material, a first transfer means which transfers toner images on the image forming body onto the intermediate transfer body or onto the obverse side of the transfer material, a second transfer means which transfers toner images on the intermediate transfer body onto the reverse side of the transfer material, and a fixing means which fixes toner images transferred onto the transfer material, wherein a curved portion which separates a transfer material from the intermediate transfer body is provided at the position on the intermediate transfer body closer to the fixing means, a transfer material guiding portion having therein a separation claw which comes in contact with a leading edge of the transfer material to be conveyed along the curved portion and spurred wheels each being rotatable and having on its outer circumferential surface plural spurs to guide the reverse side of the transfer material is provided between the curved portion and the fixing means, and a clearance is provided between the curved portion and the transfer material guiding portion, or an opening is provided on the transfer material guiding portion, which makes it possible for a current of air caused by movement of the intermediate transfer body to flow.

(3) An image forming apparatus having therein an image forming body, an intermediate transfer body which carries toner images transferred from the image forming body and supports and conveys a transfer material, a first transfer means which transfers toner images on the image forming body onto the intermediate transfer body or onto the obverse side of the transfer material, a second transfer means which transfers toner images on the intermediate transfer body onto the reverse side of the transfer material, and a fixing means which fixes toner images transferred onto the transfer material, wherein a curved portion which separates a transfer material from the intermediate transfer body is provided at the position on the intermediate transfer body closer to the fixing means, a transfer material guiding portion having therein a separation claw which comes in contact with a leading edge of the transfer material to be conveyed along the curved portion and spurred wheels each being rotatable and having on its outer circumferential surface plural spurs to guide the reverse side of the transfer material is provided between the curved portion and the fixing means, and a guide means which makes it possible for a current of air caused by movement of the intermediate transfer body to flow is provided so that it faces the curved portion and the surface of the intermediate transfer body located at the downstream side from the curved portion in the direction of movement of the intermediate transfer body.

DETAILED DESCRIPTION OF THE PREFERRED EMBODIMENT

Figure 2:
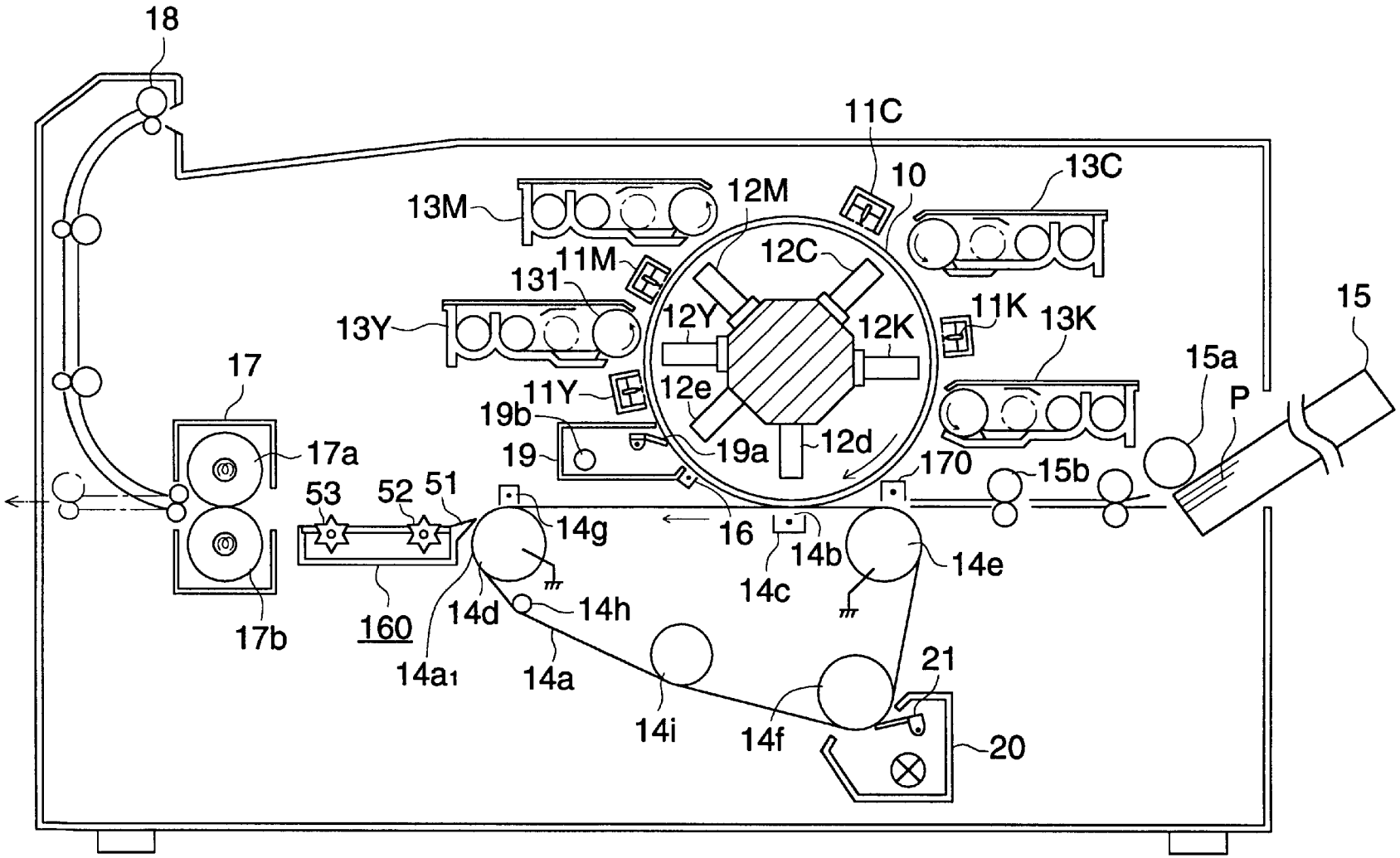
FIG. 2 is a diagram showing an overall structure of an image forming apparatus related to an embodiment.

An embodiment will be explained with reference to FIG. 2. FIG. 2 is a diagram showing an overall structure of an image forming apparatus related to an embodiment of the invention. Photoreceptor drum 10 used in the embodiment as a concrete example of an image forming body which forms on its surface toner images is one wherein a conductive layer and a photosensitive layer such as amorphous or organic photoconductive layer are formed in succession on an outer circumferential surface of a cylindrical base body made of transparent substance such as optical glass or transparent acrylic resin, for example, and it is rotated clockwise direction shown with an arrow mark with its conductive layer grounded.

Intermediate transfer body 14*a* is an endless film belt having a thickness of 0.1–0.5 mm, and the preferable is one of a two-layer type wherein a base body is made of resin such as semi-conductive polyester, polyethylene, polyethyleneterephthalate, polyimide, or ethylene tetrafluoroethylene, having resistance of $10^8$–$10^{15}$ Ωcm and a fluorine-contained resin coating having a thickness of 5–50 μm is provided on the outside of the base body as a toner filming prevention layer. Incidentally, it is preferable that the coating layer is also semi-conductive. It is also possible to use a semi-conductive rubber base body such as silicone rubber or urethane rubber having a thickness of 0.5–2.0 mm, in place of a resin base body.

The intermediate transfer body 14*a* is trained about driving roller 14*d* connected to an unillustrated driving source, driven rollers 14*e*, 14*f* and 14*i* and about tension roller 14*h*. The intermediate transfer body 14*a* is also a transfer material conveying means which conveys transfer material P to the transfer material separating position from the transfer material supply position through transfer area 14*b*. At the position of the driving roller 14*d*, the moving direction of the intermediate transfer body 14*a* is changed from the movement toward the left to the movement downward obliquely to the right in FIG. 2, and the intermediate transfer body 14*a* forms curved portion $\mathbf{14}a_1$ at this position of the driving roller 14*d*. Due to this curved portion $\mathbf{14}a_1$, transfer material P is separated from the intermediate transfer body 14*a*.

Each of charging units 11Y, 1M, 11C and 11K is composed of an LED representing a light emitting element which emits light based on inputted image signals and of an array wherein SELFOC lenses each representing an image forming element are arranged in the direction of the rotary shaft of a photoreceptor drum. Each of developing units 13Y, 13M, 13C and 13K is a developing unit which conducts non-contact reversal development with its developing sleeve 131 impressed with AC bias voltage in which DC voltage is superposed. A developing agent used for the developing unit includes two-component developing agents, and it also includes single-component developing agents.

Each of symbols Y, M, C and K represents a color of a toner image formed at each step. For example, 12Y represents an exposure unit for forming a yellow toner image, and it emits light when it is driven by image signals which form a yellow image.

When image forming is started, photoreceptor drum 10 rotates in the clockwise direction shown with an arrow mark, and the photoreceptor drum 10 is charged uniformly by scorotron charging unit 11Y first, then, imagewise exposure based on image signals of a yellow image is conducted by exposure unit 12Y, and an electrostatic latent image is formed on the photoreceptor 10. The electrostatic latent image is developed by developing unit 13Y, whereby, a yellow toner image is formed. Through subsequent rotations of the photoreceptor drum 10, charging by means of scorotron charging unit 11M, exposure by means of exposure unit 12M and development by means of developing unit 13M are conducted, and a magenta toner image is formed, then charging by means of scorotron charging unit 11M, exposure by means of exposure unit 12M and development by means of developing unit 13M are conducted, and a magenta toner image is formed, then charging by means of scorotron charging unit 11C, exposure by means of exposure unit 12C and development by means of developing unit 13C are conducted, and a cyan toner image is formed, and charging by means of scorotron charging unit 11K, exposure by means of exposure unit 12K and development by means of developing unit 13K are conducted, and a black toner image is formed. With these toner images in primary colors superposed, a reverse side color toner image is formed on the photoreceptor drum 10.

During the subsequent rotation of the photoreceptor drum 10, the photoreceptor drum 10 comes in contact with intermediate transfer body 14*a* at transfer area 14*b*, and the reverse side color toner image on the photoreceptor drum 10 is transferred onto the intermediate transfer body 14*a* through the transfer action of primary transfer unit 14*c* which is the first transfer means. The surface of the intermediate transfer body 14*a* which is opposite to its surface facing the photoreceptor drum 10 is charged by the primary transfer unit 14*c* to be of the polarity opposite to that of toner so that a transfer electric field is formed at the transfer area 14*b*, and the transfer rate is enhanced by simultaneous transfer/exposure unit 12*d*.

After the transfer, photoreceptor drum cleaning unit 19 and uniform exposure unit 12*e* operate so that the surface of photoreceptor drum 10 is cleaned to be ready for the subsequent process for forming a color toner image.

After the reverse side color toner image is formed, the photoreceptor drum 10 further rotates and there is formed on the photoreceptor drum 10 an obverse side color toner image wherein toner images of primary colors respectively of yellow, magenta, cyan and black are superposed, through the same image forming process as in the foregoing. This obverse side color toner image is formed on the photoreceptor drum 10 as an image which is obtained through mirror image processing, namely through lateral reversing on an original image. The ground for this is as follows. Since the reverse side color toner image is formed on a transfer material through two transfer processes, the image is reversed laterally twice, resulting in the relation of the normal image with an original image. However, the obverse side color toner image is in the relation of a mirror image with an original image, because it is formed on a transfer material through a single transfer process.

In synchronization with formation of the obverse side color toner image, transfer material P is fed out of sheet supply cassette 15 by feed-out roller 15*a*, and conveyed to timing roller 15*b*. The timing roller 15*b* operates in synchronization with formation of the obverse side color toner image to convey the transfer material P to transfer area 14*b*. In this case, the transfer material P is charged by transfer material charging unit 170 to the same polarity as that of toner, and is attracted to intermediate transfer body 14*a*. The reason for the transfer material P to be charged to the same polarity as that of toner is to prevent that toner is attracted due to charging to disturb images.

The obverse side color toner image on the photoreceptor drum 10 is transferred onto the upper side (surface) of transfer material P through transfer action of primary transfer unit 14*c* which is the first charging means at transfer area 14*b*. In the case of the transfer, the transfer rate is enhanced by simultaneous transfer/exposure unit 12*d*.

After the transfer of the obverse side color toner image onto transfer material P, the transfer material P and intermediate transfer body 14*a* arrive at secondary transfer unit 14*g* which is a second charging means where the reverse side color toner image on the intermediate transfer body 14*a* is transferred onto the lower side (reverse side) of the transfer material P by the charging to the polarity opposite to that of toner conducted by the secondary transfer unit 14*g*. The transfer material P having on its both sides the color toner images transferred in the aforesaid manner is separated from the intermediate transfer body 14*a* through curved portion separating action of driving roller 14*d* and separating action of separation claw 51, thus, the transfer material P carrying on its both sides unfixed toner images is guided by transfer material guiding portion 160 having spurred wheels 52 and 53 to be led to fixing unit 17 representing a fixing means. At the fixing unit 17, heat and pressure are applied between upper roller 17*a* representing an upper heating body and lower roller 17*a* representing a lower heating body each having therein a heating source, whereby color toner images are fixed.

After the color toner images are fixed, toner staying on the intermediate transfer body 14*a* is removed by cleaning blade 21 of intermediate transfer body cleaning unit 20 which is caused to come in contact with the intermediate transfer body 14*a*. Further, toner staying on photoreceptor drum 10 after the transfer is neutralized by photoreceptor drum AC neutralizing unit 16, then is scraped down by cleaning blade 19*a* of photoreceptor drum cleaning unit 19 into the photoreceptor drum cleaning unit 19, and is collected by screw 19*b* into an unillustrated toner container.

Figure 3:
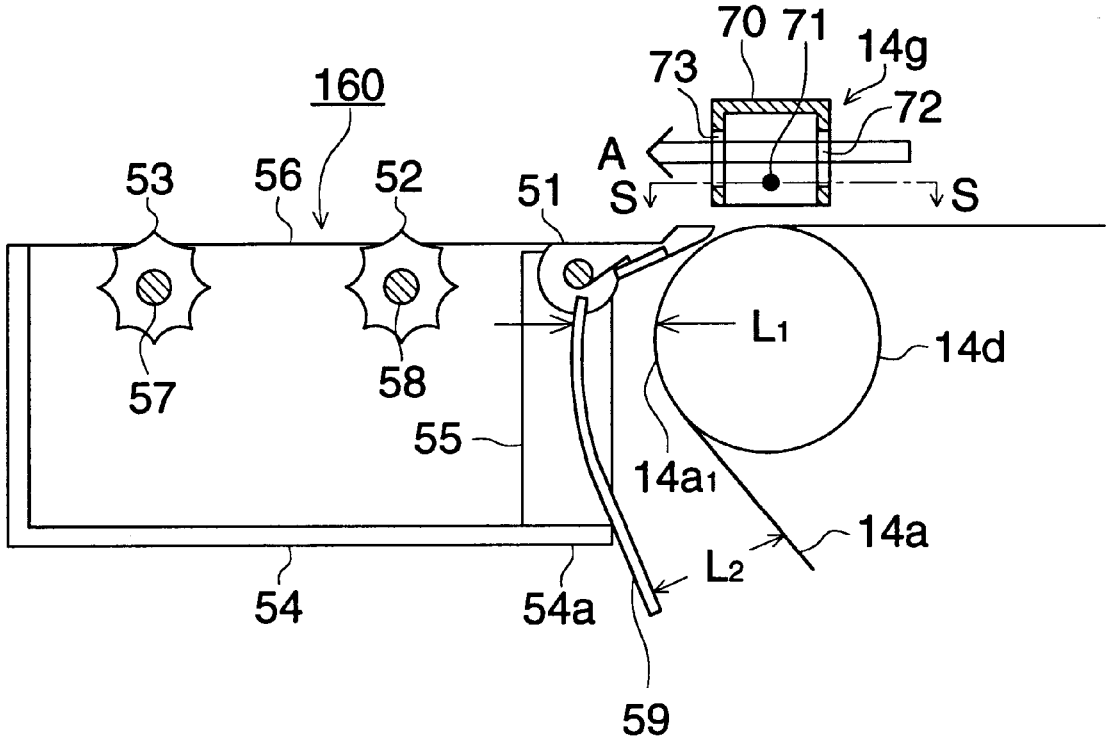
FIG. 3 is a side view of a portion where toner images are transferred from an intermediate transfer body onto a transfer material in the image forming apparatus in FIG. 2.
Figure 4:
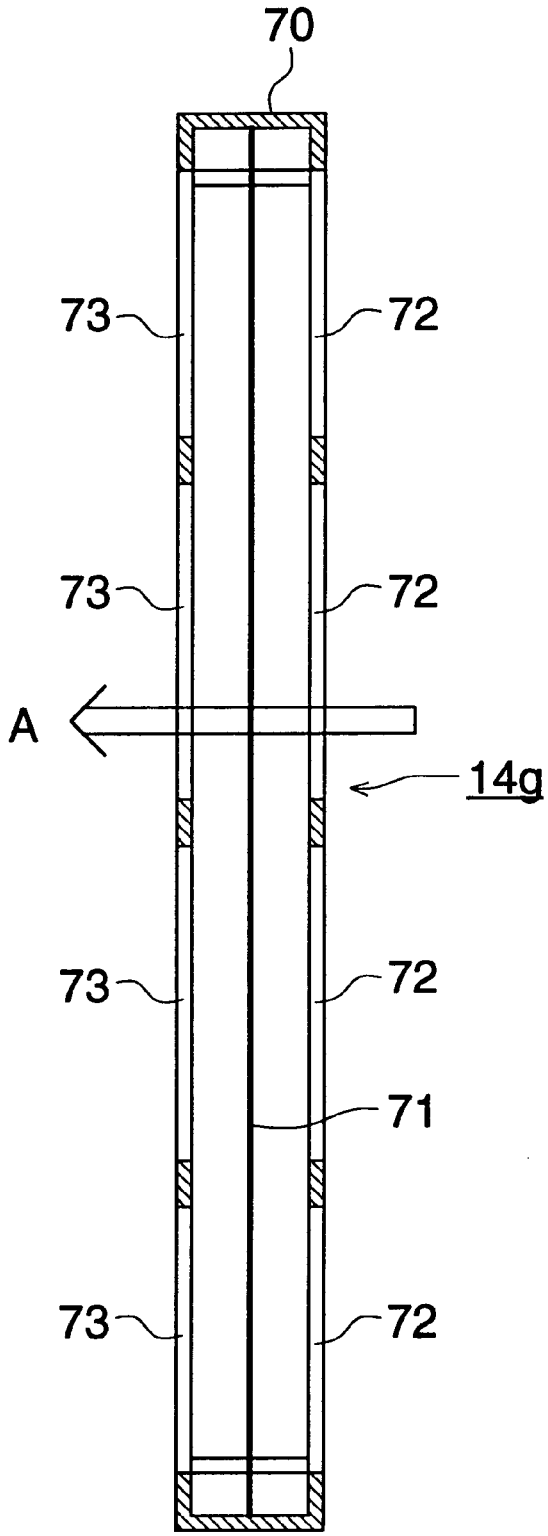
FIG. 4 is a sectional view taken on line S—S in FIG. 3 of a secondary transfer unit.
Figure 5:
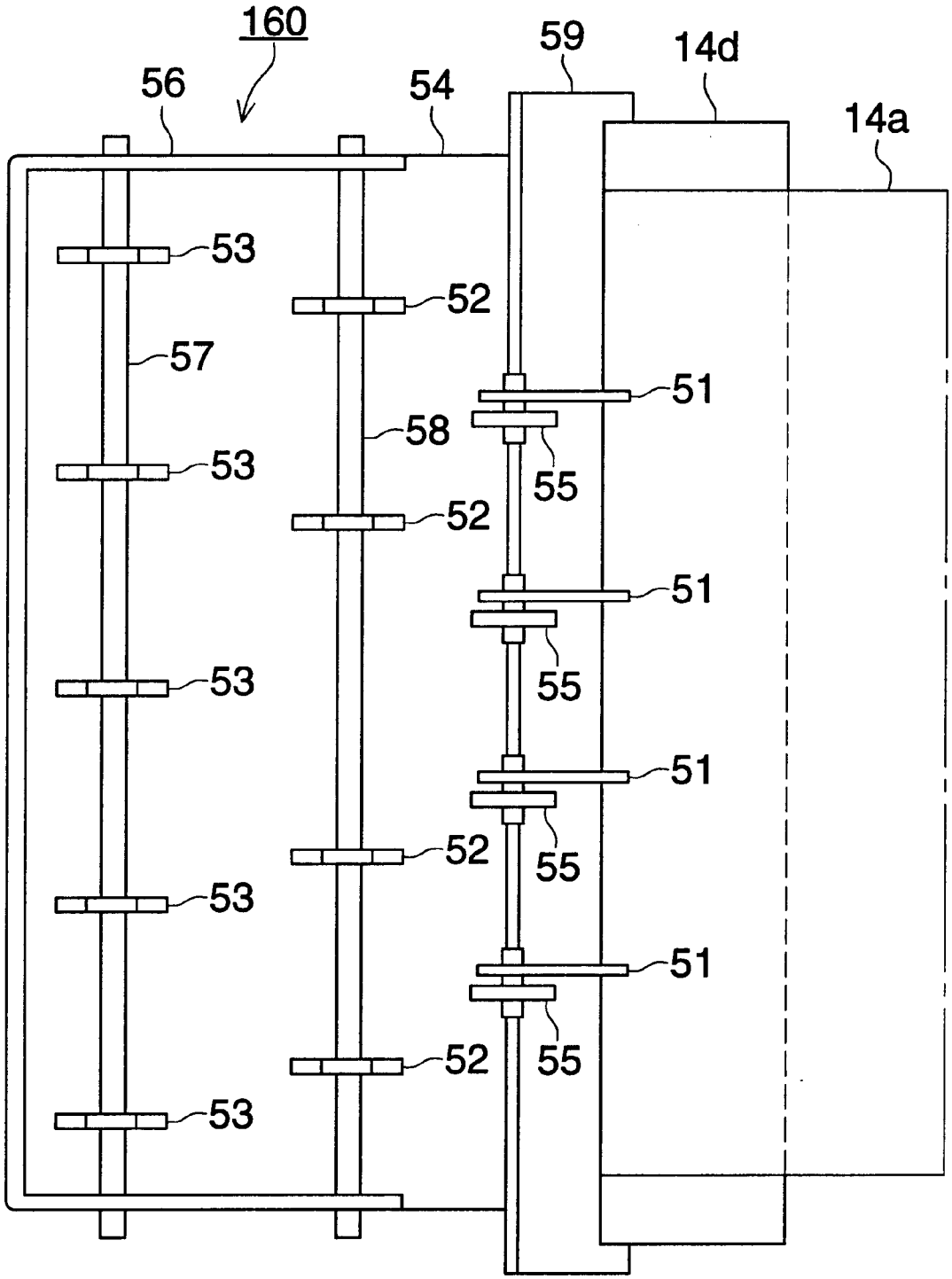
FIG. 5 is a top view of an image forming apparatus portion shown in FIG. 3.
Figure 6:
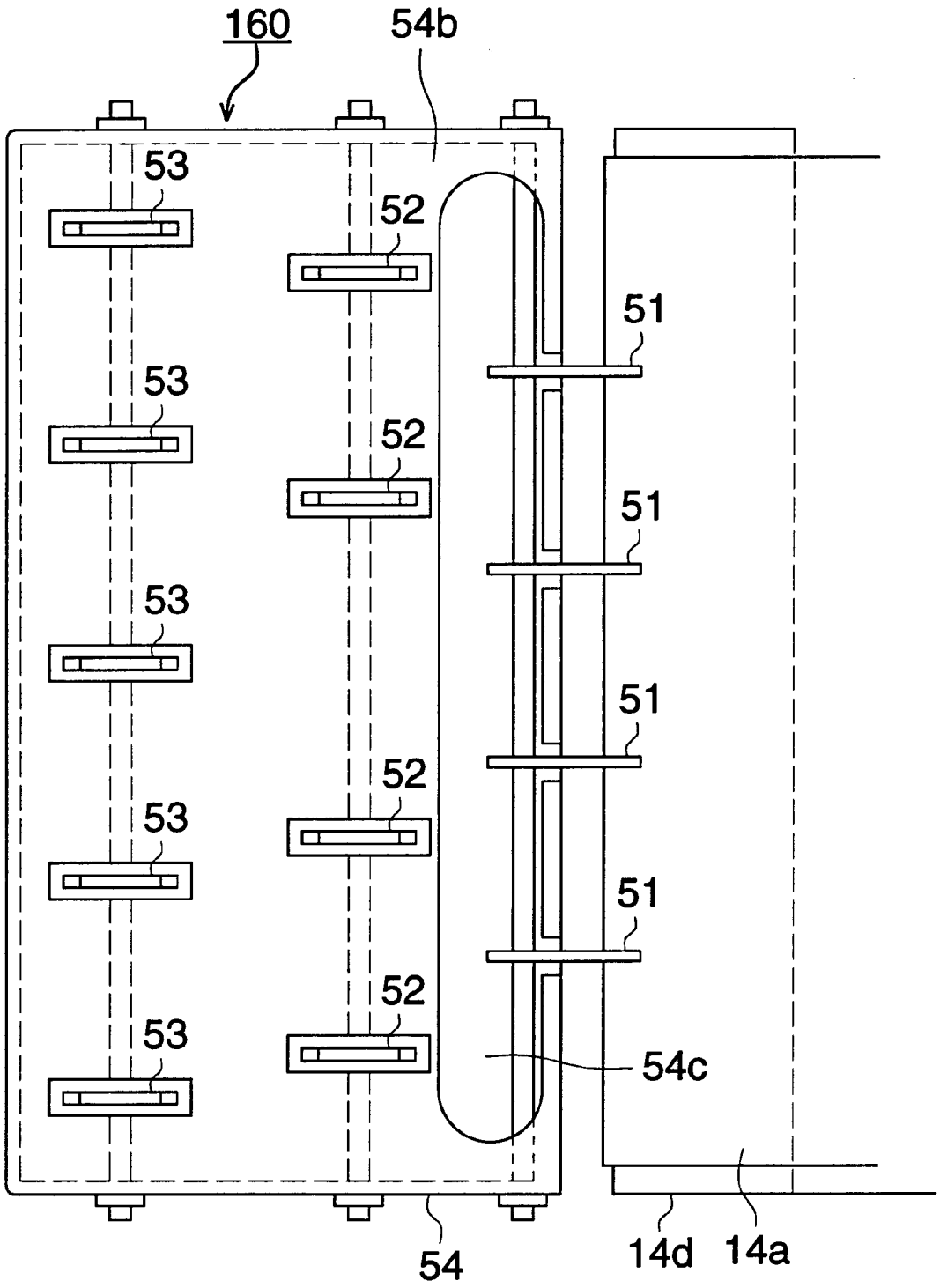
FIG. 6 is a top view of another embodiment related to the portion where toner images are transferred from an intermediate transfer body onto a transfer material in an image forming apparatus.

Next, the primary portions of the present embodiment will be explained with reference to FIGS. 3–6. FIG. 3 is a side view of the portion of an image forming apparatus where toner images are transferred from an intermediate body onto a transfer material, FIG. 4 is a sectional view of the secondary transfer unit taken on line S—S in FIG. 3, FIG. 5 is a top view of a portion where toner images shown in FIG. 3 are transferred from an intermediate transfer body onto a transfer material, and FIG. 6 is a top view of another embodiment of the portion of an image forming apparatus where toner images are transferred from an intermediate transfer body to a transfer material.

Figure 1:
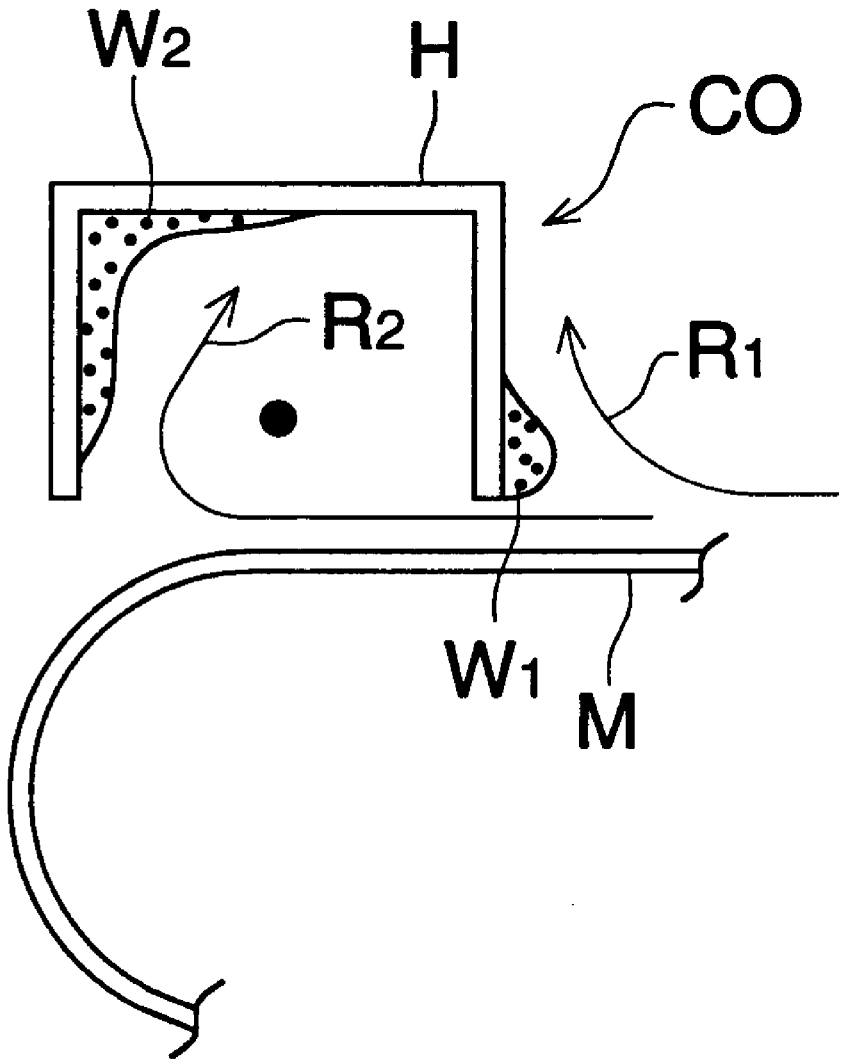
FIG. 1 is a diagram illustrating toner soil on a transfer unit.

Secondary transfer unit 14*g* which transfers toner images from intermediate transfer body 14*a* onto transfer material P is composed of shielding member 70 which shields an electric field in corona discharge and of corona discharge wire 71. On the shielding member 70, there are provided air circulation hole 72 at the upstream side and air circulation hole 73 at the downstream side, both in the transfer material conveyance direction. As shown in FIG. 4, several air circulation holes 72 and several air circulation holes 73 are provided respectively at positions which are mostly the same each other in the longitudinal direction of the secondary transfer unit 14*g*, and they are arranged so that air current A may be formed along the outer circumferential surface of the intermediate transfer body 14*a*. Due to the constitution of the secondary transfer unit 14*g* stated above, there is formed air current A flowing from the upstream side of the transfer separation position in the direction for conveying a transfer material to the downstream side of the transfer separation position, in the vicinity of the secondary transfer unit 14*g* as shown in FIG. 1, thus, disturbance of the air current on and in the vicinity of the secondary transfer unit 14*g* can be prevented and thereby sticking of toner to shielding member 70 can be prevented.

When using an AC corona neutralizing unit which neutralizes transfer material P for separating the transfer material P from the intermediate transfer body 14*a*, it is preferable to provide also on a shielding member of the AC corona neutralizing unit a circulation hole through which air passes from the upstream side to the downstream side in the direction of conveyance of a transfer material, in the same way as in the foregoing.

As shown in FIG. 3, curved portion $\mathbf{14}a_1$ of the intermediate transfer body 14*a* is formed at the downstream side of the transfer position in the direction of conveyance of a transfer material by driving roller 14*d*, and transfer material P is separated from the intermediate transfer body 14*a* through a separating function of the curved portion $\mathbf{14}a_1$. Separation claw 51 is provided to be close to the curved portion $\mathbf{14}a_1$ of the intermediate transfer body 14*a*. As illustrated, a tip of the separation claw 51 is close to the surface of the intermediate transfer body 14*a*, and when transfer material P is conveyed by the intermediate transfer body 14*a* to be about to move along the curved portion 14$a_1$ of the intermediate transfer body 14*a*, the separation claw 51 touches the leading edge of the transfer material P and separates the transfer material P surely from the intermediate transfer body 14*a*.

As illustrated, transfer material guide portion 160 which separates the transfer material P from the intermediate transfer body 14*a* and leads it to fixing unit 17 is composed of supporting frame 54 and of separation claw 51 and spurred wheels 52 and 53 which are supported by the supporting frame 54. Each of spurred wheels 52 and 53 is a guide member having on its outer circumference plural projections which guides transfer material P carrying on its lower side unfixed toner images by guiding the transfer material with the projections without disturbing the toner images.

End portion 54*a* of the supporting frame 54 closer to the intermediate transfer body 14*a* is formed to have the distance that is enough to form an air current path between the end portion 54*a* and the intermediate transfer body 14*a*. On the other hand, the separation claw 51 for separating transfer material P from the intermediate transfer body 14*a* needs to be provided to be close to the intermediate transfer body 14*a*. For satisfying these conditions, separation claw supporting arm 55 is provided to be extended from the supporting frame 54, and separation claw 51 is attached on the edge of the separation claw supporting arm 55. Spurred wheels 52 and 53 which guide the transfer material P separated from the intermediate transfer body 14*a* to a fixing unit are pivoted respectively on shaft 58 and shaft 57 both fixed on side wall 56 of the supporting frame 54.

For preventing disturbance of an air current at the downstream side of secondary transfer unit 14*g* in the direction of conveyance of a transfer material, guide plate 59 representing a guide means is provided along an outer circumferential surface of the intermediate transfer body 14*a* on the end portion of transfer material guide portion 160 closer to the intermediate transfer body 14*a*, as shown in FIGS. 3 and 5. The guide plate 59 forms an air current path along an outer circumferential surface of the intermediate transfer body 14*a* between itself and the intermediate transfer body 14*a*, and a smooth flow of air is assured by making width $L_1$ of the current path closer to the air flow-in side to be narrower than width $L_2$ of the current path closer to the air flow-out side. Further, by impressing voltage with the same polarity as that of toner (negative voltage in the present embodiment) on the guide plate 59, toner is prevented from sticking to the guide plate 59.

Trouble caused by toner sticking to a transfer material guide portion such as spurred wheels 52 and 53 can be prevented by providing enough distance between the transfer material guide portion 160 and the intermediate transfer body 14*a* as stated above, and it is further possible to prevent thoroughly the sticking of toner to each member constituting the transfer 21 material guide portion 160, by providing, at the aforesaid distance, the guide plates 59 which guide air current.

It is also possible to arrange the transfer material guide portion 160 so that supporting frame 54 for spurred wheels may have upper cover 54*b* for the transfer material guide portion, as shown in FIG. 6, and thereby to form air circulation hole 54*c* on the upper cover 54*b*. Even by this arrangement, an air current path along an outer circumferential surface of the intermediate transfer body 14*a* can be formed, and whereby, troubles of the toner sticking to the transfer material guide portion 160 can be prevented.

Toner soil is generally remarkable in the vicinity of the transfer position where toner images are transferred from an intermediate transfer body onto a transfer material, but the invention has eliminated such toner soil and has made it possible to obtain images with high image quality stably.

What is claimed is:

1. An image forming apparatus comprising:

(a) an image forming body for forming toner images;

(b) an intermediate transfer body for carrying a first toner image transferred from the image forming body, and for conveying a transfer material;

(c) a first transfer unit for transferring the first toner image from the image forming body onto the intermediate transfer body, and for transferring a second toner image from the image forming body onto a front side of the transfer material;

(d) a second transfer unit for transferring the first toner image on the intermediate transfer body onto a back side of the transfer material;

(e) a fixing device for fixing the first and second toner images transferred onto the transfer material;

(f) a curved portion provided on the intermediate transfer body at a side of the fixing device for separating the transfer material from the intermediate transfer body;

(g) a transfer material guiding portion provided between the curved portion and the fixing device, said transfer material guiding portion having a separation claw which contacts a leading edge of the transfer material transferred along the curved portion and a rotatable spurred wheel having a plurality of protrusions on a circumferential surface thereof for guiding the back side of the transfer material; and (h) a guiding member, provided facing the curved portion downstream of a moving direction of the intermediate transfer body, for allowing air caused by movement of the intermediate transfer body to flow along an outer circumferential surface of the intermediate transfer body;

wherein the second transfer unit comprises a corona discharger having a discharging electrode and a shielding member for shielding an electric field when the discharging electrode discharges, and wherein the shielding member includes openings on an upstream side and a downstream side thereof through which air flows along the outer circumferential surface of the intermediate transfer body from upstream to downstream in a conveyance direction of the transfer material.

2. The image forming apparatus of claim 1, wherein the guiding member forms an air flow path to the intermediate transfer body which is more narrow on an upstream side of the intermediate transfer body than on a downstream side of the intermediate transfer body.

3. The image forming apparatus of claim 2, wherein a voltage having a same polarity as that of toner transferred onto the intermediate transfer body is applied to the guiding member.

4. An image forming apparatus comprising:

(a) an image forming body for forming toner images;

(b) an intermediate transfer body for carrying a first toner image transferred from the image forming body, and for conveying a transfer material;

(c) a first transfer unit for transferring a second toner image from the image forming body onto a front side of the transfer material;

(d) a second transfer unit for transferring the first toner image carried on the intermediate transfer body onto a back side of the transfer material;

(e) a fixing device for fixing the first and second toner images transferred onto the transfer material;

(f) a curved portion provided on the intermediate transfer body at a side of the fixing device for separating the transfer material from the intermediate transfer body;

(g) a transfer material guiding portion provided between the curved portion and the fixing device, said transfer material guiding portion having a separation claw which contacts a leading edge of the transfer material transferred along the curved portion and a rotatable spurred wheel having a plurality of protrusions on a circumferential surface thereof for guiding the back side of the transfer material; and (h) a guiding member, provided facing the curved portion downstream of a moving direction of the intermediate transfer body, for allowing air caused by movement of the intermediate transfer body to flow along an outer circumferential surface of the intermediate transfer body;

wherein the second transfer unit comprises a corona discharger having a discharging electrode and a shielding member for shielding an electric field when the discharging electrode discharges, and wherein the shielding member includes openings on an upstream side and a downstream side thereof through which air flows along the outer circumferential surface of the intermediate transfer body from upstream to downstream in a conveyance direction of the transfer material.

5. The image forming apparatus of claim 4, wherein the guiding member forms an air flow path to the intermediate transfer body which is more narrow on an upstream side of the intermediate transfer body than on a downstream side of the intermediate transfer body.

6. The image forming apparatus of claim 5, wherein a voltage having a same polarity as that of toner transferred onto the intermediate transfer body is applied to the guiding member.

7. An image forming apparatus comprising:

(a) an image forming body;

(b) an intermediate transfer body for carrying a toner image transferred from the image forming body and conveying a transfer material thereon;

(c) a first transfer means for transferring the toner image on the image forming body onto the intermediate transfer body or a front side of the transfer material;

(d) a second transfer means for transferring the toner image on the intermediate transfer body onto a back side of the transfer material; and (e) a fixing means for fixing the toner image transferred onto the transfer material, wherein the second transfer means comprises a corona discharger having a discharging electrode and a shielding member for shielding an electric field when the discharging electrode discharges, wherein the shielding member has a circulation hole through which air flows along an outer circumferential surface of the intermediate transfer body from upstream to downstream in a conveyance direction of the transfer material, and wherein the image forming apparatus further comprises:

(f) a curved portion provided on a side of the fixing means of the intermediate transfer body for separating the transfer material from the intermediate transfer body;

(g) a transfer material guiding portion provided between the curved portion and the fixing means having a separation claw which comes in contact with a leading edge of the transfer material transferred along the curved portion and a rotatable spurred wheel having a plurality of protrusions on the circumferential surface thereof for guiding the back side of the transfer material; and (h) a guiding means provided facing the curved portion to a surface of the intermediate transfer body downstream of a moving direction thereof, for allowing air caused by movement of the intermediate transfer body to flow along the circumferential surface of the intermediate transfer body.

8. The image forming apparatus of claim 7, wherein the guiding means forms an air flow path to the intermediate transfer body in which the air flow path is narrow on an upstream side and wide on a downstream side of the intermediate transfer body.

9. The image forming apparatus of claim 8, wherein a voltage having the same polarity as that of toner transferred onto the intermediate transfer body is applied to the guiding means.

* * * * *